US011574508B2

(12) United States Patent
Stringfield

(10) Patent No.: US 11,574,508 B2
(45) Date of Patent: Feb. 7, 2023

(54) PREDICTIVE, PREVENTATIVE AND CONDITIONAL MAINTENANCE METHOD AND SYSTEM FOR COMMERCIAL VEHICLE FLEETS

(71) Applicant: David A. Stringfield, St. Augustine, FL (US)

(72) Inventor: David A. Stringfield, St. Augustine, FL (US)

( * ) Notice: Subject to any disclaimer, the term of this patent is extended or adjusted under 35 U.S.C. 154(b) by 0 days.

(21) Appl. No.: 17/739,545

(22) Filed: May 9, 2022

(65) Prior Publication Data

US 2022/0358794 A1 Nov. 10, 2022

Related U.S. Application Data

(60) Provisional application No. 63/185,676, filed on May 7, 2021.

(51) Int. Cl.
*G07C 5/00* (2006.01)
*G07C 5/08* (2006.01)

(52) U.S. Cl.
CPC ..... *G07C 5/006* (2013.01); *G07C 5/008* (2013.01); *G07C 5/0808* (2013.01)

(58) Field of Classification Search
CPC ..... G07C 5/006; G07C 5/008; G07C 5/0808; G07C 5/00; G08G 1/00; G08G 1/20
See application file for complete search history.

(56) References Cited

U.S. PATENT DOCUMENTS 7,356,393 B1 * 4/2008 Schlatre ..... G06Q 10/06 701/36
11,509,136 B2 * 11/2022 Visweswariah .... G05B 23/0227
2014/0229391 A1 * 8/2014 East, III ..... G06Q 10/20 705/305
2016/0035150 A1 * 2/2016 Barfield, Jr. ..... G05B 23/0254 701/29.3
2016/0078695 A1 * 3/2016 McClintic ..... G07C 5/0816 701/29.4
2017/0349058 A1 * 12/2017 Bernier ..... H02J 13/00028
2018/0374060 A1 12/2018 Viswanath et al.
2019/0244442 A1 8/2019 Kyes et al.
(Continued)

OTHER PUBLICATIONS

Website of Blue Ocean Tactics—https://www.blueoceantactics.com/fleet-services.

*Primary Examiner* — Yonel Beaulieu
(74) *Attorney, Agent, or Firm* — Burr & Forman LLP; Jeffrey H. Kamenetsky

(57) ABSTRACT

A computer-based method for predicting vehicle component failures from a fleet of vehicles and taking corrective action. The method includes receiving maintenance data regarding a vehicle component, receiving from a vehicle's telemetry device, sensor data for the vehicle component. obtaining manufacturer's recommended service data for the vehicle component, the maintenance data, the sensor data, and the manufacturer's recommended service data collectively forming vehicle component data, comparing the stored vehicle component data to a statistical behavioral model for the vehicle component to produce vehicle component comparative data, and applying the vehicle component comparative data to a predictive maintenance algorithm for the vehicle component to predict a date of failure of the vehicle component.

18 Claims, 9 Drawing Sheets

(56) References Cited

U.S. PATENT DOCUMENTS

| | | | | |
|---|---|---|---|---|
| 2019/0318549 | A1 | 10/2019 | Zeira et al. | |
| 2020/0293392 | A1 | 9/2020 | Alves et al. | |
| 2022/0252411 | A1* | 8/2022 | Gardiner | G01C 21/3461 |

* cited by examiner

PREDICTIVE, PREVENTATIVE AND CONDITIONAL MAINTENANCE METHOD AND SYSTEM FOR COMMERCIAL VEHICLE FLEETS

CROSS REFERENCE TO RELATED APPLICATION

This application claims priority to U.S. Provisional Patent Application No. 63/185,676, titled, FleetMatrix, the disclosure of which is incorporated by reference.

FIELD

The present disclosure relates to vehicular maintenance and more specifically to a method and system for predicting, preventing and responding to vehicle component failure for a fleet of vehicles.

BACKGROUND

Typically, vehicular maintenance is based on two of the following conditions. The first condition is the manufacturer's recommended service schedule for that vehicle. The second condition is the operator's operation of the vehicle that signals to the operator that there is a problem, or repair needed, for the vehicle. That signal may be in the form of a noticeable change in vehicle operation, such as a lack of previous capacity to perform a function, or an internal sensor (such as a "Check Engine" light) that is alerting the operator that repairs are needed. Recently, through the adoption of Global Positioning System ("GPS")-based vehicle telematics devices, a third condition has emerged that allows for preventative maintenance. Vehicles with telematics devices provide information such as exact odometer readings, engine hours, and may have additional sensors that are able to communicate a variety of data electronically.

This telematics data is available to vehicle managers and vehicle owners who are then able to make decisions regarding maintenance that would be considered preventative if it is conducted before a vehicle requires a repair. However, there is a need in the industry for a computer-based system and method that aggregates the various types of vehicular conditions described above with telematics data to provide a dynamic and manageable conditional-based maintenance system that can effectively predict vehicle component maintenance and failure, and provide a service schedule to prevent future vehicular component failure for a fleet of vehicles.

SUMMARY

In one aspect of the present disclosure, a computer-based method for predicting vehicle component failures from a fleet of vehicles and taking corrective action, is provided. The method comprises: after a first inspection of a vehicle component of a vehicle in the fleet of vehicles, receiving accessing maintenance data regarding a the vehicle component, the maintenance data contained in at least one of a driver vehicle inspection report (DVIR), a Department of Transportation (DOT) form, and a Post Maintenance Inspection (PMI) form; after a subsequent inspection of the vehicle component, accessing updated maintenance data of the vehicle component from at least one of the DVIR, DOT form, and PMI form, the updated maintenance data including at least one of hours and miles the vehicle with the vehicle component has driven since the first inspection; receiving from a vehicle's telemetry device, sensor data for the vehicle component obtaining manufacturer's recommended service data for the vehicle component, the updated maintenance data, the sensor data, and the manufacturer's recommended service data collectively forming vehicle component data; comparing the stored vehicle component data to a statistical behavioral model for the vehicle component to produce vehicle component comparative data; and applying the vehicle component comparative data to a predictive maintenance algorithm for the vehicle component to predict a date of failure of the vehicle component.

In another aspect of the disclosure, a predictive, preventative and conditional maintenance system for predicting vehicle component failures from a fleet of vehicles and taking corrective action, the system comprises: a processor in communication with a memory, the memory configured to store a predictive maintenance algorithm for a vehicle component and a communications interface comprising a receiver and a transmitter, wherein after a first inspection of a vehicle component of a vehicle in the fleet of vehicles, the receiver configured to: receive access maintenance data regarding a the vehicle component, the maintenance data contained in at least one of a driver vehicle inspection report (DVIR), a Department of Transportation (DOT) form, and a Post Maintenance Inspection (PMI) form; and after a subsequent inspection of the vehicle component, access updated maintenance data of the vehicle component from at least one of the DVIR, DOT form, and PMI form, the updated maintenance data including at least one of hours and miles the vehicle with the vehicle component has driven since the first inspection; and receive from a vehicle's telemetry device, sensor data for the vehicle component, the received updated maintenance data and sensor data together with manufacturer's recommended service data for the vehicle component forming vehicle component data. The processor is configured to: compare the vehicle component data to a statistical behavioral model for the vehicle component to produce vehicle component comparative data; and apply the vehicle component comparative data to the predictive maintenance algorithm for the vehicle component to predict a date of failure of the vehicle component.

DETAILED DESCRIPTION OF EXEMPLARY EMBODIMENTS

The present disclosure relates to a method and system for predicting, preventing and responding to vehicle component failure for a fleet of vehicles. Different types of data relating to one or more vehicle components from one or more vehicles in a fleet of vehicles is obtained by various means. For example, one type of data is "maintenance data," which relates to data obtained from the vehicle itself indicating that there is or may be a problem with the vehicle or indicating a noticeable change in the operation of the vehicle. For example, the vehicle may indicate that there is a problem with the engine by activating a "check engine" light, or that a tire is low on air by activating a "check tire pressure" light. Maintenance data can also include changes to the vehicle that are noticed by the operator of the vehicle. For example, the driver may noticed the brakes are not operating properly, or the vehicle hesitates or does not accelerate properly, or one of the tires looks low, etc. Another type of data considered by the present disclosure is "telematics" or "sensor" data. This type of data is obtained by one or more telematics or sensor devices within or outside the vehicle. Telematics data includes such things as exact odometer readings, engine hours, etc. Other types of vehicle sensors have the ability to detect this type of information and communicate a variety of telematics data electronically to, for example, a home server or network. These types of vehicle component data can be gathered for all vehicles in a fleet of vehicles.

The method of the present disclosure obtains and aggregates both maintenance data and telematics data. Another type of data considered by the present disclosure is the vehicle manufacturer's recommended services schedule. This data includes information about when the manufacturer of the vehicle suggests service for each of the various vehicle components. The present disclosure obtains each of these types of data for each vehicle component, aggregates the data, and applies the aggregated data to a statistical model, which is then applied to an algorithm or multiple algorithms, which results in a prediction as to if and when the various vehicle components will encounter a failure. Using this approach, vehicle components of vehicles within a fleet of vehicles can be monitored, and a prediction of when each vehicle component is likely to fail can be calculated and distributed to the vehicle owner/technician or fleet manager, resulting in a substantial cost saving. In the context of this disclosure, "vehicle component" can mean any component within or on a vehicle.

Figure 1:
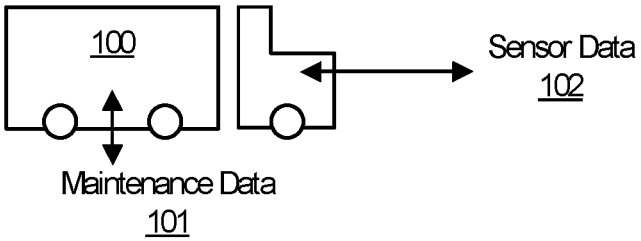
FIG. 1 illustrates the use of maintenance data and sensor data as types of vehicular component data that can be used to predict vehicular component failure in accordance with embodiments of the present disclosure.

Referring now to FIG. 1, it can be seen that a vehicle 100 can accumulate both maintenance data 101 and telematics or sensor data 102 (the terms "telematics data," "sensor data," and "telematics/sensor data 102" are used interchangeably throughout this disclosure). As discussed above, maintenance data 101 can include indicators from the vehicle or its operator indicating that there may be a problem with the vehicle or that there may be a noticeable change in the operation of the vehicle. Maintenance data 101 can also include changes to the vehicle that are noticed by the operator of the vehicle. Sensor data 102 is obtained from various telematics devices ("sensors") within or outside the vehicle. The methodology of the present disclosure uses both types of data to calculate a prediction of when one or more vehicle components in vehicles of a larger vehicle fleet may fail.

Figure 2:
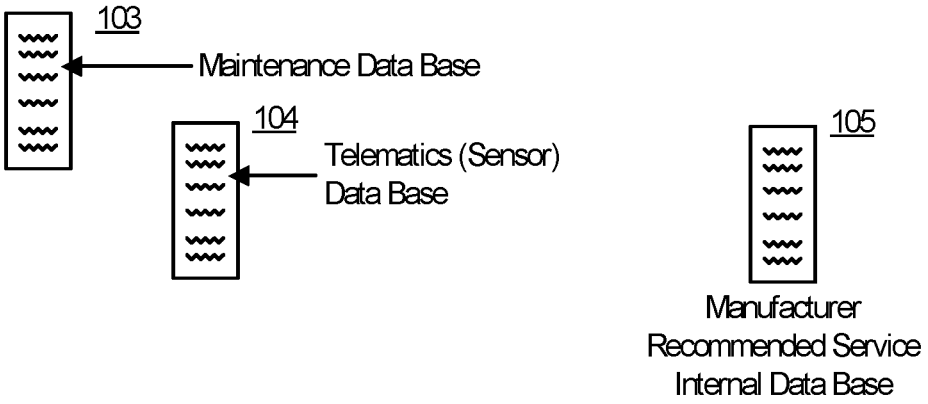
FIG. 2 illustrates the different databases that are used to store different types of vehicular component data in accordance with embodiments of the present disclosure.

In FIG. 2, maintenance data 101 is stored in a maintenance database 103, while telematics or sensor data 102 is stored in a telematics database 104. A third type of data may also be considered when predicting vehicle component failure. Data from the manufacturer of the vehicle can indicate when the manufacturer of the vehicle suggests service at various intervals for each of the various vehicle components. This type of data is stored in a manufacturer's recommended service interval database 105. The term "vehicle component data" as used herein shall mean some combination of maintenance data 101, sensor data 102, and manufacturer's recommended service data.

Figure 3:
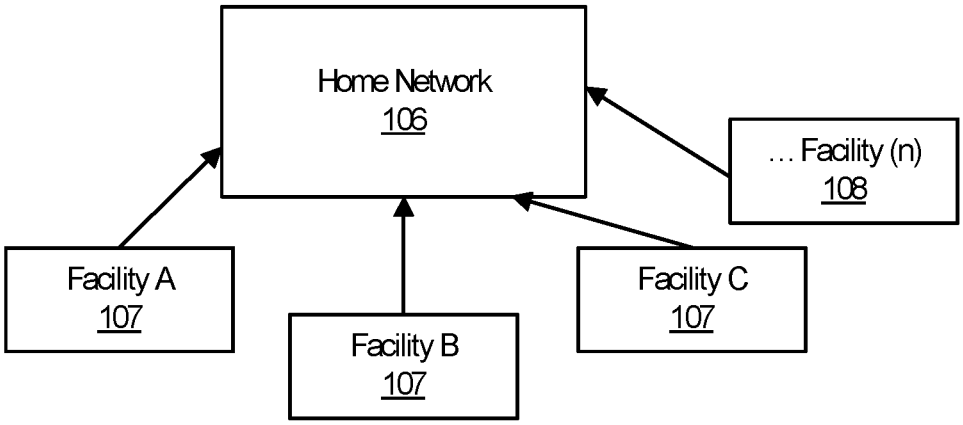
FIG. 3 illustrates a collective network of an unlimited number service facilities, each utilizing the methodology of the present disclosure to receive and aggregate vehicular component data to identify and prevent future vehicle component failure.

In FIG. 3, facilities 107 represent individual service facilities that collect and transmit vehicle component data to a collective home network 106. Home network 106 can receive and manage all of the vehicle component data received from each facility 107 (this can be an unlimited number represented by Facility (n) 108), where each facility obtains its own vehicle component data from each vehicle in its fleet.

Figure 4:
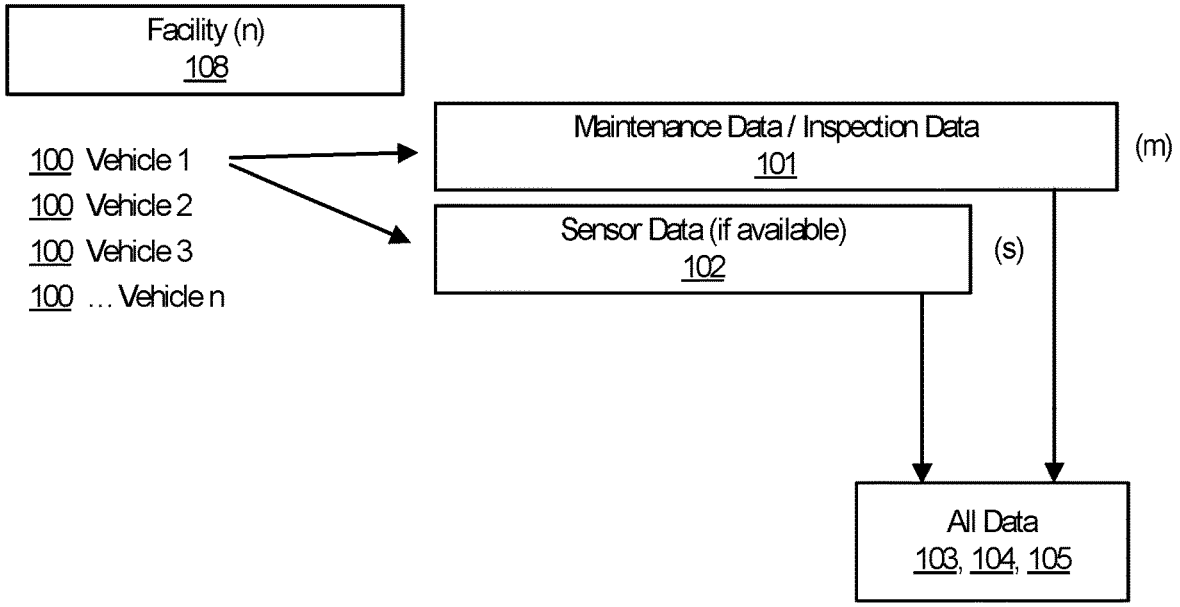
FIG. 4 illustrates how an unlimited number of service facilities can be used to obtain vehicular component data from an unlimited number of vehicles in accordance with embodiments of the present disclosure.

In FIG. 4, it can be seen that in each service facility 107/108, vehicle component data is obtained from the various (an unlimited number of) vehicles 100 in the fleet.

Maintenance (inspection) data 101 is securely transmitted to and stored in maintenance database 103, while sensor data 102, if available, is transmitted to and stored in telematics database 104. Manufacturer's recommended service data for each vehicle component is also stored in its own database, database 105.

Figure 5:
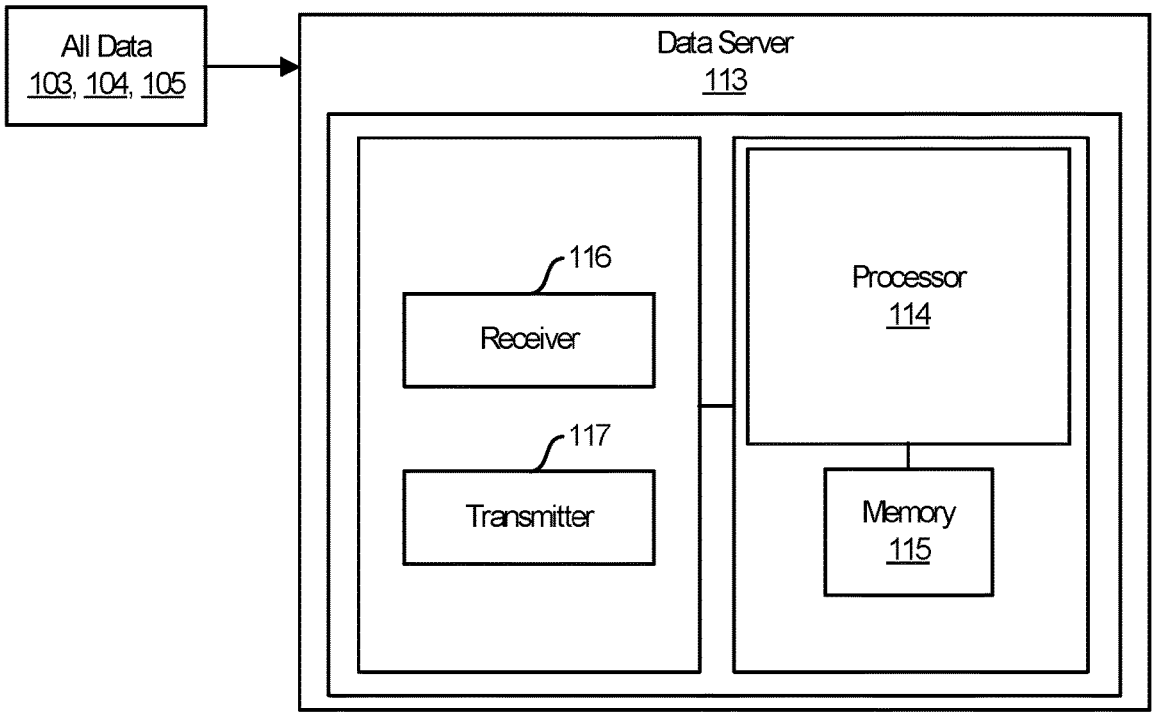
FIG. 5 illustrates the data server that receives and processes the vehicular component data in accordance with embodiments of the present disclosure.

FIG. 5 shows data server 113, which is configured to obtain and process vehicle component data from each of the databases 103, 104 and 105. Data server 113, which can be a single server or multiple servers, and in one embodiment, may be located in home network 106, queries each of the databases (maintenance database 103, telematics database 104, and manufacturer's recommended service database 105) to obtain the vehicle component data and applies this data to a statistical model for each particular vehicle component. The result is used as input to a predictive maintenance algorithm, which predicts when each particular vehicle component is likely to fail.

Data server 113 includes a processor 114, memory, and associated circuitry 115, antenna circuitry (not shown), and a communications interface that includes a receiver and associated circuitry 116, and a transmitter and associated circuitry 117. The data server 113 may include additional components not shown in FIG. 4. Processor 114, using one or more algorithms, which are stored, for example, in memory 115, is configured to perform all the calculations necessary to predict vehicle component failure dates in accordance with the embodiments of the present disclosure. Receiver 116 and transmitter 117 communicate with facilities 107/108 to, respectively, receive vehicle component data and transmit predicted vehicle component failure dates and recommended service schedules.

Figure 6:
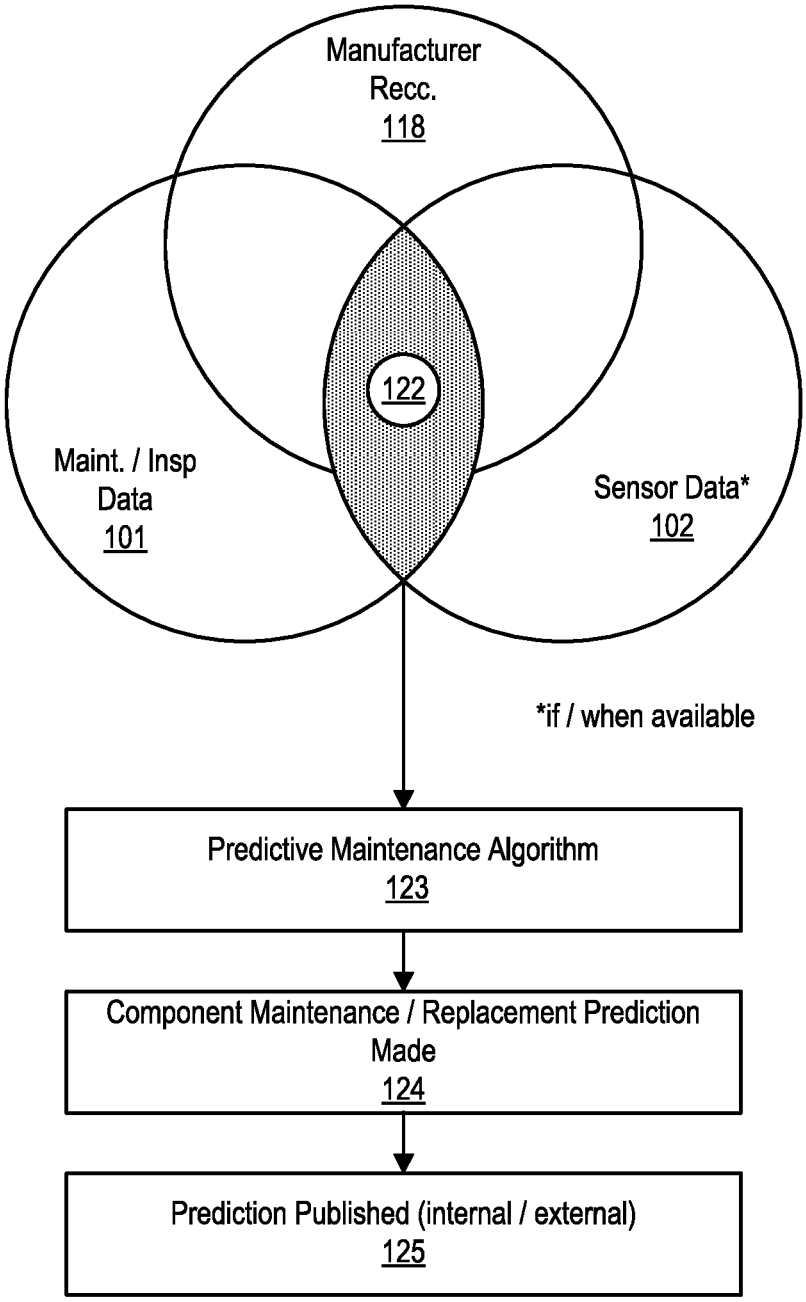
FIG. 6 illustrates how the aggregation of different types of vehicular component data is applied as input to a predictive maintenance algorithm to predict vehicle component failure in accordance with embodiments of the present disclosure.

FIG. 6 illustrates how data server 113 aggregates maintenance inspection data 101, telematics/sensor data 102 and manufacturer's vehicle component recommended service data 118 at step 122, in order to apply the aggregated data to a predictive maintenance algorithm, at step 123. A prediction, based on the results of the application of the vehicle component data to the predicted maintenance algorithm(s), as to when maintenance should be performed on the vehicle component in question (or the component replaced), at step 124, and in some embodiments, this prediction is published, i.e., sent to the owner or operator of the vehicle having the vehicle component in question, or the operator of the fleet with the vehicle, or the service center, at step 125.

In one non-limiting use example of the process shown in FIG. 6, the vehicle component is a vehicle's brake pads. The three different types of vehicle component data relating to the brake pads in question (maintenance data 101, telematics data 102, and manufacturer's recommended service data 118) are considered. Thus, for example, manufacturer's vehicle component recommended service data 118 for a particular vehicle's brake pads might indicate that the manufacturer recommends that the brake pads be replaced at 70,000 miles, every 18 months, and/or when the brake pads measure less than 10/32 of an inch, whichever event comes first. Maintenance data 101 for the brake pads could include measurements of the brake pads each time the vehicle was inspected at a service facility 107. Sensor data 102, collected from one or more telemetry devices or sensors on the vehicle might indicate that the vehicle has had a certain number of harsh breaking incidents 141 (see FIG. 12(*c*)) since the installation of the vehicle's brake pads. All of this data is accumulated, stored in their respective database, and transmitted to or otherwise obtained by data server 113 for processing. Processor 114 of data server 113 then applies this data to an algorithm or algorithms to arrive at a predicted date of failure the brake pads. In one embodiment, a time buffer is applied to the predicated failure date of the vehicle component. The predicted failure date and/or time buffer date can then be published, at step 125, to the operator of the vehicle with the brake pad and/or the fleet manager, or service facility 107 associated with that vehicle so that the vehicle operator, the fleet manager and the service center have ample time to conduct the required preventative maintenance by replacing the brake pads prior to the predicted failure date.

A non-limiting example of how processor 114 calculates a predicted failure date of a vehicle component by applying a predictive maintenance algorithm according to an embodiment of the present disclosure is as follows. Processor 114 uses a predictive algorithm that is a function of information contained in one or more digital forms, e.g., a driver vehicle inspection report (DVIR) 129, Department of Transportation (DOT) forms, Post Maintenance Inspection (PMI) forms (each discussed below and shown in FIG. 8), as well as the estimated remaining life of a vehicle component. This information could include, for example, the miles and/or hours that a vehicle containing the vehicle component in question has driven in a certain period of time. A mathematical equation can then be used to predict the useful life of a vehicle component.

For example, in one embodiment, a technician opens a digital form (e.g., DVIR, DOT, PMI, etc.) for vehicle A. The technician records the tires' remaining tread depth in 32nds of an inch (this tire depth measurement is purely exemplary and any tire depth measurement can be used). The digital forms are updated accordingly and this information is accessed by data server 113. When the next service on vehicle A is performed, the same process occurs. Thus, data server 113 has access to the latest service information about all of the vehicle components on vehicle A (in this case, its tires). Processor 114 uses an algorithm to then calculate the wear that has occurred between services on the tires and predicts when failure of the tire will occur in the future. Using this information, home network 106 updates vehicle A's service calendar in order to schedule tire service for Vehicle A in advance of the predicted failure date.

As an example, the following information is obtained from inspection and/or a digital form:

| July 7, 2021 | September 7, 2021 |
|---|---|
| Vehicle 7<br>Miles: 10,000<br>Hours: 500<br>Tire tread depth: 18/32 inch | Vehicle 7<br>Miles: 20,000<br>Hours: 1,000<br>Tire tread depth: 16/32 inch |

On Jul. 7, 2021, vehicle 7 was serviced and its current mileage (10,000 miles) and hours since last service (500) recorded. Also recorded is its tire tread depth (18/32"). On Sep. 7, 2021, vehicle 7 is again serviced and these same measurements are recorded. It should be noted that miles, hours, and tire tread depth (as well as the two-month maintenance checks) are being used here in an exemplary fashion to illustrate how vehicle component data is used by processor 114 using a sample algorithm to predict a vehicle component failure date. The present disclosure is not limited in this fashion, and other vehicle component data can be used.

Thus, in 2 months, and 10,000 miles of vehicle operation, the tire tread depth of at least one of the tires of vehicle 7 shows 2/32 of an inch of wear. Thus, at the current usage rate for vehicle 7, the tire depth wears at about 1/32 of an inch per month. If the Department of Transportation or manufacturer's recommended minimal tire tread depth is 4/32 of an inch, there is 12/32 of an inch of wear depth remaining before the manufacturer's recommended limit is reached. The algorithm can then predict that at vehicle 7's current tire wear rate, (1/32" per month), it would take another 12 months (or 60,000 miles) for the tire tread depth to decrease to 4/32 of an inch, which is the minimal tire depth recommended by the tire manufacturer. Thus, using this prediction algorithm by processor 14, home network 106 schedules vehicle 7 to have its tires replaced no later than Sep. 7, 2022 (or before vehicle 7 has traveled 80,000 miles). As mentioned above, in one embodiment, a time buffer may be applied to the predicated failure date of the vehicle component. Thus, the vehicle owner or fleet operator can be notified that the tire or tires of vehicle 7 are scheduled to be replaced by, for example, Aug. 17, 2022, three weeks before the predicted failure date of vehicle 7's tire.

The more frequent that data (maintenance data 101 and/or telematics/sensor data 102) is gathered about the vehicle component, the more precise the predicted date of failure calculation is. The algorithm explained herein and used by processor 114 can be used for any vehicle component such as, for example, tires, brakes or any other wearable vehicle item.

In another embodiment, processor 114 will calculate the difference between a matched pair of tires and will automatically predict failure of a pair of tires that have, for example, 4/32" of tread depth difference between the two tires. In another embodiment, processor 114 will predict that a tire will fail if the tire that is, for example, 20% or more greater than the recommended tire pressure. For example, a tire is rated for 105 PSI, and when a technician checks the inflation of the tire and it is 80 PSI. Using the calculation above (105 PSI×20%=84 PSI), the tire is predicted to fail and needs further inspection. Further calculations can be used to predict approximately when failure when occur (this could depend on variables such as, for example, how many miles the vehicle travels daily, the type of roads the vehicle is traveling on, weather factors, etc.)

Figure 7:
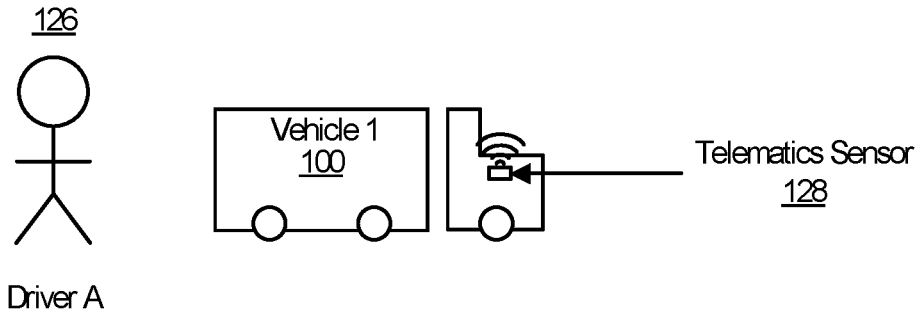
FIG. 7 illustrates the use of a telematics sensor to produce telematics data that is used to predict vehicle component failure in accordance with embodiments of the present disclosure.

FIG. 7 illustrates the use of telematics sensor 128 to produce telematics data 102 that is used to predict vehicle component failure in accordance with embodiments of the present disclosure. As discussed herein, a vehicle 100 with operator/driver 126 may include one or more telemetry devices or sensors 128 on or inside of vehicle 100. The amount and frequency of telematics data 102 that is sensed and collected by the telemetry device(s) 128 can vary according to the type of service subscription operator/driver 126 has purchased. As also discussed herein, telematics data 102 is transmitted to an entity (this could be a server for example) that includes (or has access to) a telematics database 104 where the telematics data 102 obtained from sensor(s) 128 is stored.

Figure 8:
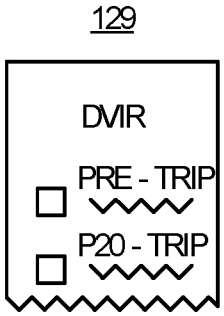
FIG. 8 illustrates a driver vehicle inspection report used in accordance with embodiments of the present disclosure.

FIG. 8 illustrates a driver vehicle inspection report (DVIR) 129 used in accordance with embodiments of the present disclosure. The DVIR 129 is a report that user 126 or other technician can fill out both before and after vehicle 100 is used. The Department of Transportation (DOT) requires a driver (or technician) of a commercial vehicle to conduct both a pre-trip and a post-trip vehicle inspection. When user 126 (or technician) of vehicle 100 indicates on DVIR 129 that a vehicle component is defective, the system also indicates on related forms (e.g., a DOT form or a Post Maintenance Inspection (PMI) form). When user 126, or a technician marks a vehicle component as repaired on DVIR 129, then all related DOT and PMI forms are updated accordingly. Thus, maintenance database 103 and telematics database 104 and are constantly being revised and updated by the information contained in received DVIRs 129. When a DVIR 129 is completed, the software application of the present disclosure extracts the relevant and up-to-date maintenance data 101 and telematics data 102. This information is sent to or otherwise accessed by data server 113 and home network 106.

Figure 9:
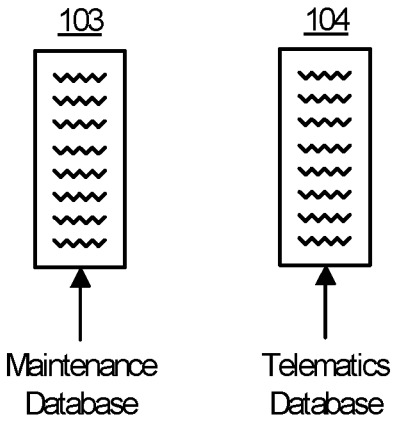
FIG. 9 illustrates a maintenance database storing maintenance data and a telematics database storing telematics data, where each type of data is used to predict vehicle component failure in accordance with embodiments of the present disclosure.

FIG. 9 illustrates maintenance database 103 containing up-to-date maintenance data 101 that was recorded in DVIR 129 and telematics database 104 containing up-to-date telematics data 102 that was recorded in DVIR 129 and obtained by sensors 128.

Figure 10:
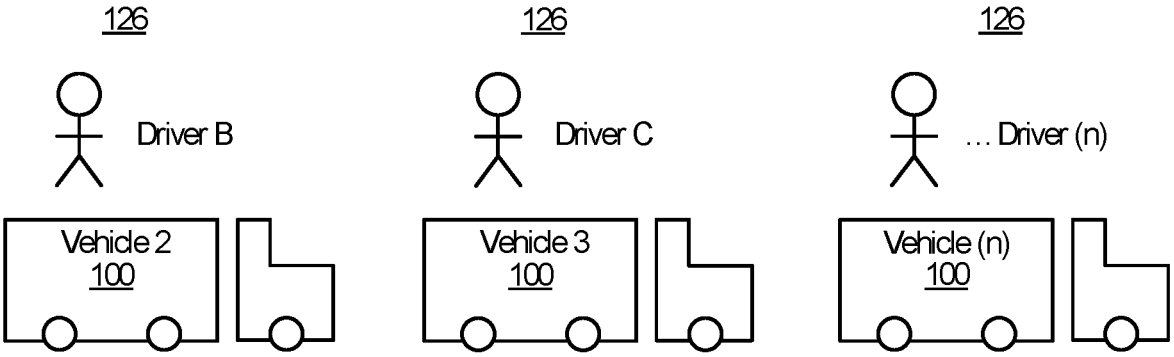
FIG. 10 illustrates the methodology of the present disclosure used to obtain vehicular component data from an unlimited number of vehicles.

In FIG. 10, it can be seen that the system and method of the present disclosure can be applied to a multiple (unlimited) number of vehicles in a fleet of vehicles. Thus, the method and system of the present disclosure can be extrapolated to obtain vehicle component information for any number of vehicles in a fleet of vehicles, from any number of service facilities.

Figure 11:
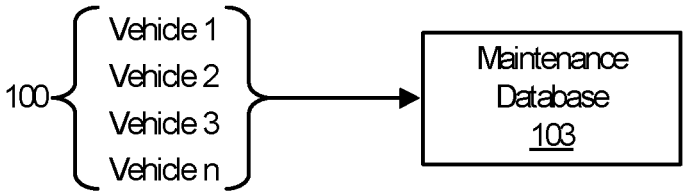
FIG. 11 illustrates a maintenance database at a service facility that receives vehicular component maintenance data from an unlimited number of vehicles in accordance with embodiments of the present disclosure.

In FIG. 11, maintenance database 103 stores vehicle component information in the form of maintenance data 101 obtained from multiple vehicles. As discussed herein, maintenance data 101 is information obtained from the vehicle itself that indicates that there is or may be a problem associated with a particular vehicle component of the vehicle or indicating a noticeable change in the operation of a vehicle component of the vehicle. Maintenance data 101 can also include changes to the vehicle that are noticed by the operator of the vehicle.

FIGS. 12A-12D provide examples of different types of telemetry/sensor data 102 that can be detected by sensors 128 associated with vehicle 100, and used, in conjunction with maintenance data 101, and/or manufacturer's recommended service data 105 to predict a failure date of a vehicle component, in this case a vehicle's brake pads. It should be noted, that in some cases, one or more of these aforementioned types of data may not be available. For example, vehicle 100 may not be equipped with telematics devices 128 or the telematics device 128 is not functioning. Thus, in these instances, processor 114 may provide a prediction as to the failure date of a particular vehicle component based solely on maintenance data 101 and manufacturer's recommended service data 105. In other instances, maintenance data 101 may not be available or there may be no noticeable changes in the operation of the vehicle components of the vehicle. In these instances, processor 114 of data center 113 predicts vehicle component failure dates based upon sensor data 102 and manufacturer's recommended service data 105.

Figure 12A:
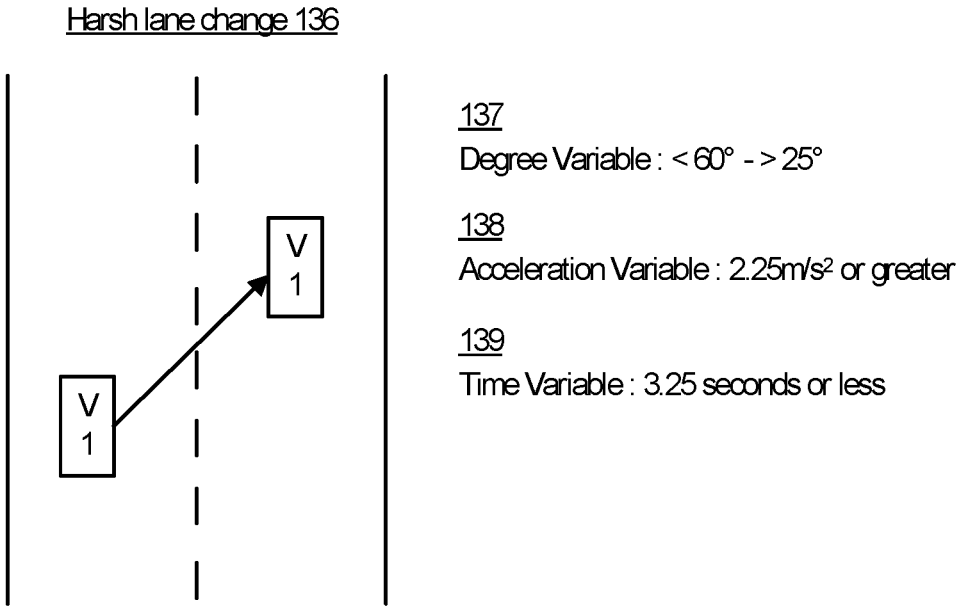
FIG. 12A is an example of one type of telematics data used in accordance with embodiments of the present disclosure.

Referring now to FIG. 12A, one example of sensor data 102 collected from one or more telemetry devices or sensors 128 on vehicle 100 might indicate that vehicle 100 has had a certain number of harsh lane changes 136 since the installation of the vehicle's tires. In one embodiment, a harsh lane change 136 is defined as a non-straight directional change in movement by a vehicle (V1) where the vehicle's variable shift in direction 137 is greater than 25 degrees but less than 60 degrees, where the vehicle accelerates during the directional shift at a rate 138 of 2.25 meters/second$^2$ or greater and where the shift occurs within a time span 139 of 3.25 seconds or less.

Figure 12B:
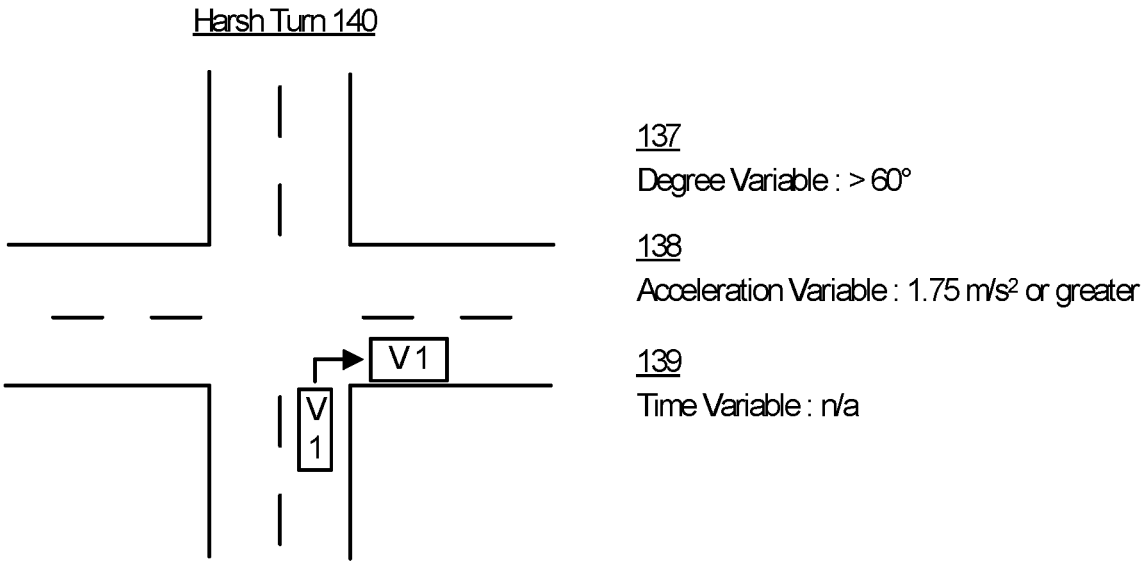
FIG. 12B is an example of another type of telematics data used in accordance with embodiments of the present disclosure.

FIG. 12B is another example of sensor data 102 that can be used by processor 114 of the present disclosure to calculate and predict the date of a vehicle's tire failure. Sensor device 128 may detect when vehicle 100 has made a harsh turn 140. In one embodiment, harsh turn 140 is defined as when vehicle 100 makes a non-straight directional change in movement 137 that is in excess of 60 degrees, while vehicle 100 accelerates at a rate 138 of 1.75 meters/second$^2$ or greater.

Figure 12C:
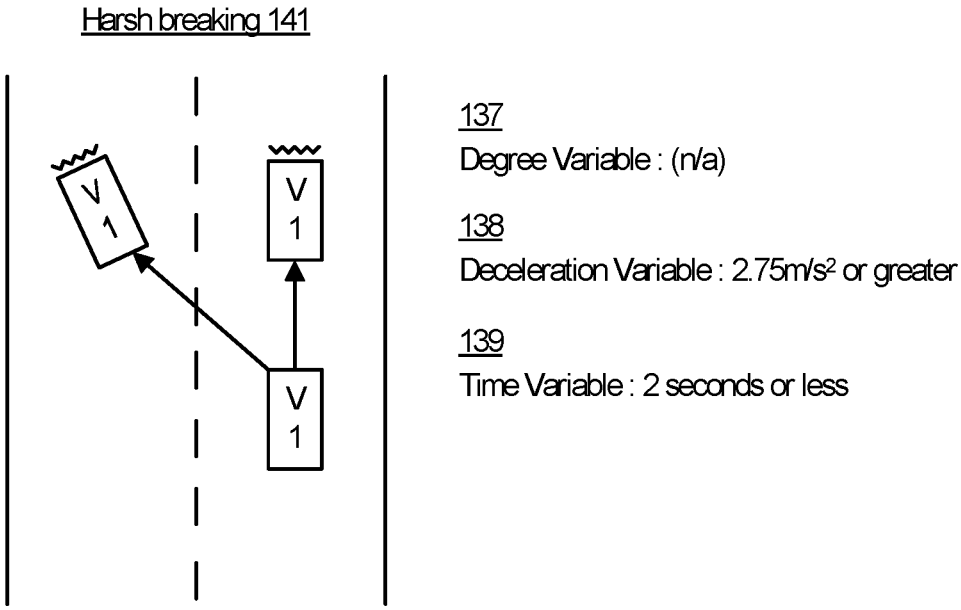
FIG. 12C is an example of yet another type of telematics data used in accordance with embodiments of the present disclosure.

FIG. 12C is yet another example of sensor data 102 that can be used by processor 114 of the present disclosure to calculate and predict the date of a vehicle's brake pads failure. In this scenario, a harsh breaking event 141 is identified. In one embodiment, a harsh breaking event 141 is defined as linear or non-linear reduction in speed (deceleration) at a rate 138 of 2.75 meters/second$^2$ or greater within a time frame 139 of 2 seconds or less.

Figure 12D:
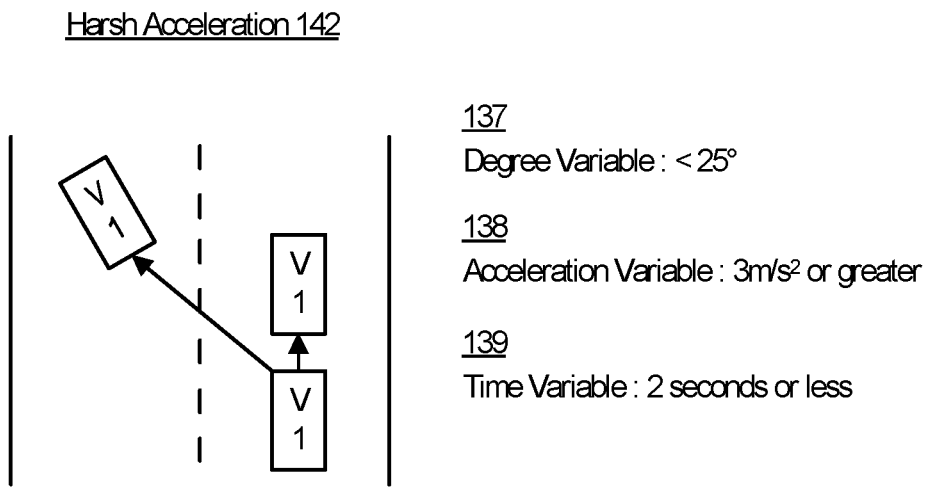
FIG. 12D is an example of still another type of telematics data used in accordance with embodiments of the present disclosure.

FIG. 12D is still another example of sensor data 102 that can be used by processor 114 of the present disclosure to calculate and predict the date of a vehicle's tire failure. In this example, a harsh acceleration event 142 is defined as a non-straight directional change in movement of the vehicle 137 less than 25 degrees and a linear or non-linear increase in speed at an acceleration rate 138 greater than 3 meters/second$^2$ for a time period 139 of 2 seconds or less.

Figure 13:
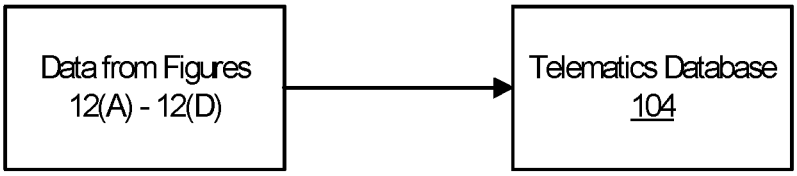
FIG. 13 illustrates how the different types of telematics data shown in FIGS. 12(A)-12(D) is stored in a telematics database in accordance with embodiments of the present disclosure.

The above are examples of sensor data 102 detected by one or more sensors 128 associated with vehicle 100. This sensor data 102 is used by processor 114 to calculate a prediction of the date of failure of the vehicle's brake pads and/or tires. The sensor data 102 can be used in conjunction with the vehicle's maintenance data 101 and manufacturer's service recommendation data 105 as part of an algorithm as shown in the example above. As shown in FIG. 13, telematics database 104 collects and stores the data that is obtained by sensor devices 128 on each vehicle 100, such as the sensor data 102 shown in FIGS. 12A-12D.

Figure 14:
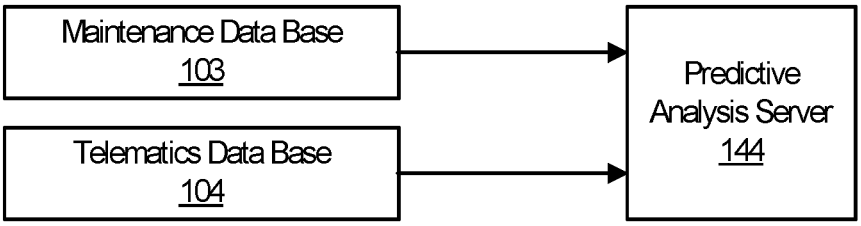
FIG. 14 illustrates how a predictive analysis server queries the data in the maintenance database and the telematics database in accordance with embodiments of the present disclosure.

In FIG. 14, it can be seen that maintenance data 101 stored in maintenance database 103 is combined with sensor data 102 stored in telematics database 104 to be used by a predictive analysis server 144. Predictive analysis server 144 can be part of data server 113 or home network 106, and contain processor 114, which performs the predictive vehicle component failure analysis discussed herein. Not shown in FIG. 14 is manufacturer's vehicle component recommended service data 118, stored in a separate database 105, which can also be utilized by processor 114 and predictive analysis server 144 to predict the date of a vehicle component's failure.

Figure 15:
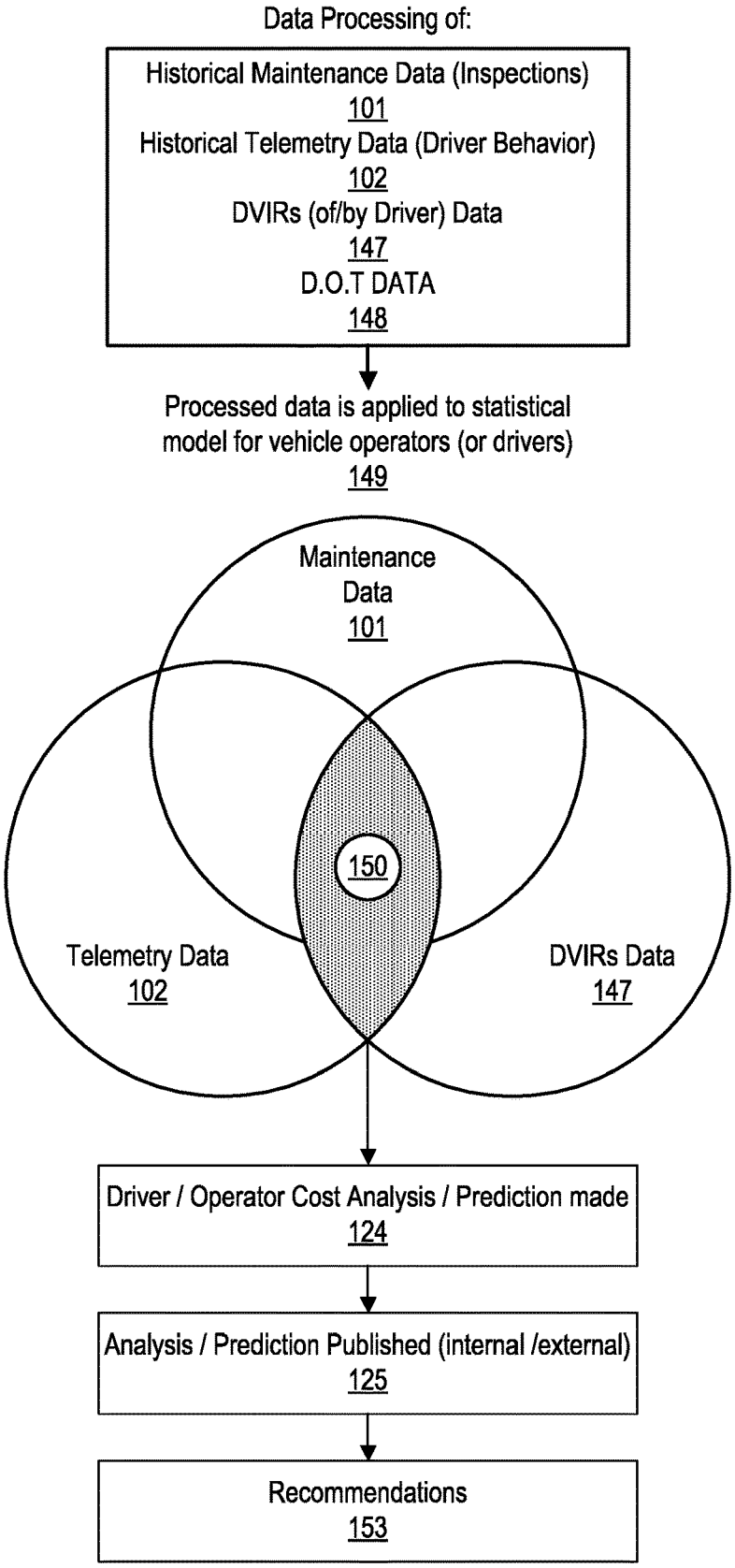
FIG. 15 illustrates how data servers aggregate all available vehicular component data from various databases as input to a statistical model in order to predict vehicular component failure in accordance with embodiments of the present disclosure.

FIG. 15 shows an exemplary sequence of steps where historical maintenance data 101, which typically comes from user/technician inspection of the vehicle 100, historical telemetry data 102, which is obtained from sensors 128 in or on the vehicle and indicates driver behavior, DVIR data 147 and DOT data 148 is collected. This data is processed and applied to a statistical model for that driver/operator of the vehicle 100 and applied to a driver analysis algorithm, step 149. The algorithm then predicts the cost benefit analysis for that driver/operator, step 124. The prediction may be published (this could mean internally routed within an organization or published externally), step 125. The published prediction may recommend, for example, that service for a vehicle component be scheduled a certain number of days before the predicted failure date, step 153.

Figure 16:
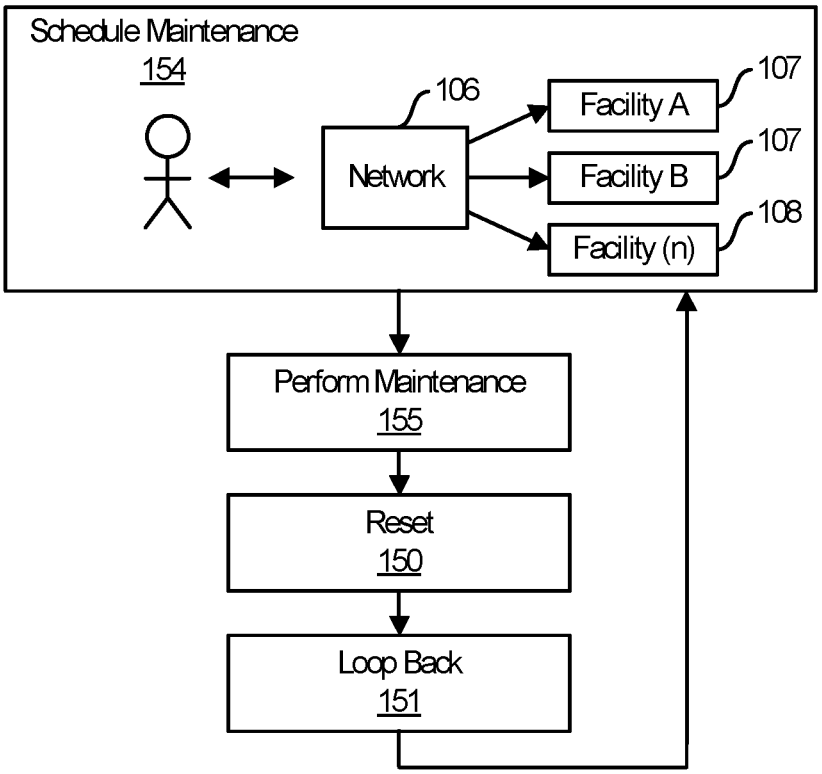
FIG. 16 illustrates the scheduling of a service recommendation and the coordination of the service through a provider in accordance with embodiments of the present disclosure.

FIG. 16 illustrates a scenario where a manager of a fleet of vehicles may, based on the predicted failure date, make the decision to schedule service 154 and selects a service provider. Home network 106, using a service scheduler program notifies the selected service provider and once the time and date of the service is agreed upon, the service provider obtains access to the service portal and all related digital forms. Maintenance is performed on the vehicle component, at step 155, and processor 114 resets the days, hours, and miles on all digital forms. The process resets, at step 150 and loops back, at step 151.

In one embodiment, when a vehicle experiences a mechanical failure/break down, the vehicle operator, using the software application of the present disclosure, can activate a "break down" icon on their computing device and the software application will populate the computing device with repair facilities, listing those nearest to the driver first. The driver can then select the facility of choice and the software application will provide contact information and directions to the facility using directional navigations systems such as GPS, etc.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the embodiments described herein are not limited to what has been particularly shown and described herein above. In addition, unless mention was made above to the contrary, it should be noted that all of the accompanying drawings are not to scale. A variety of modifications and variations are possible in light of the above teachings.

What is claimed is:

1. A computer-based method for predicting vehicle component failures from a fleet of vehicles and taking corrective action, the method comprising:

after a first inspection of a vehicle component of a vehicle in the fleet of vehicles, accessing maintenance data regarding the vehicle component, the maintenance data contained in at least one of a driver vehicle inspection report (DVIR), a Department of Transportation (DOT) form, and a Post Maintenance Inspection (PMI) form;

after a subsequent inspection of the vehicle component, accessing updated maintenance data of the vehicle component from at least one of the DVIR, DOT form, and PMI form, the updated maintenance data including at least one of hours and miles the vehicle with the vehicle component has driven since the first inspection;

receiving from a vehicle's telemetry device, sensor data for the vehicle component;

obtaining manufacturer's recommended service data for the vehicle component, the updated maintenance data, the sensor data, and the manufacturer's recommended service data collectively forming vehicle component data;

comparing the stored vehicle component data to a statistical behavioral model for the vehicle component to produce vehicle component comparative data; and applying the vehicle component comparative data to a predictive maintenance algorithm for the vehicle component to predict a date of failure of the vehicle component.

2. The method of claim 1, further comprising publishing the predicted date of failure of the vehicle component.

3. The method of claim 1, further comprising calculating and applying a time buffer to the predicted date of failure to provide a predictive failure buffer date.

4. The method of claim 3, further comprising informing at least an owner or operator of the vehicle having the vehicle component the predictive failure buffer date.

5. The method of claim 3, further comprising recommending service of the vehicle component based upon the predictive failure buffer date.

6. The method of claim 5, further comprising coordinating the recommended service with a service provider on or before the predictive failure buffer date.

7. The method of claim 1, further comprising recommending a replacement of the vehicle component based on the predicted failure of the vehicle component.

8. A predictive, preventative and conditional maintenance system for predicting vehicle component failures from a fleet of vehicles and taking corrective action, the system comprising:

a processor in communication with a memory, the memory configured to store a predictive maintenance algorithm for a vehicle component; and a communications interface comprising a receiver and a transmitter, wherein after a first inspection of a vehicle component of a vehicle in the fleet of vehicles, the receiver configured to:

access maintenance data regarding the vehicle component, the maintenance data contained in at least one of a driver vehicle inspection report (DVIR), a Department of Transportation (DOT) form, and a Post Maintenance Inspection (PMI) form; and after a subsequent inspection of the vehicle component, access updated maintenance data of the vehicle component from at least one of the DVIR, DOT form, and PMI form, the updated maintenance data including at least one of hours and miles the vehicle with the vehicle component has driven since the first inspection; and receive from a vehicle's telemetry device, sensor data for the vehicle component, the updated maintenance data and sensor data together with manufacturer's recommended service data for the vehicle component forming vehicle component data; the processor configured to:

compare the vehicle component data to a statistical behavioral model for the vehicle component to produce vehicle component comparative data; and apply the vehicle component comparative data to the predictive maintenance algorithm for the vehicle component to predict a date of failure of the vehicle component.

9. The system of claim 8, further comprising publishing the predicted date of failure of the vehicle component.

10. The system of claim 8, wherein the processor is further configured to calculate and applying a time buffer to the predicted date of failure to provide a predictive failure buffer date.

11. The system of claim 10, further comprising informing at least an owner or operator of the vehicle having the vehicle component the predictive failure buffer date.

12. The system of claim 10, further comprising recommending service of the vehicle component based upon the predictive failure buffer date.

13. The system of claim 12, further comprising coordinating the recommended service with a service provider on or before the predictive failure buffer date.

14. The system of claim 8, further comprising recommending a replacement of the vehicle component based on the predicted failure of the vehicle component.

15. The method of claim 1, further comprising updating a service calendar for the vehicle in order to schedule service on the vehicle component prior to the predicted date of failure of the vehicle component.

16. The system of claim 8, the processor further configured to update a service calendar for the vehicle in order to schedule service on the vehicle component prior to the predicted date of failure of the vehicle component.

17. The method of claim 1, further comprising:

storing the manufacturer's recommended service data for the vehicle component in a manufacturer's recommended service interval database;

storing the updated maintenance data in a maintenance database;

storing the sensor data in a telematics database;

upon receipt of the latest DVIR, updating the latest DOT and PMI forms; and revising the contents of the maintenance database and the telematics database to reflect the information contained in the latest received DVIR.

18. The system of claim 8, the processor further configured to:

store the manufacturer's recommended service data for the vehicle component in a manufacturer's recommended service interval database;

store the updated maintenance data in a maintenance database;

store the sensor data in a telematics database;

upon receipt of the latest DVIR, update the latest DOT and PMI forms; and revise the contents of the maintenance database and the telematics database to reflect the information contained in the latest received DVIR.

* * * * *